US010386061B2

(12) United States Patent
Hong

(10) Patent No.: US 10,386,061 B2
(45) Date of Patent: Aug. 20, 2019

(54) METHOD AND APPARATUS FOR FIRETUBE BOILER AND ULTRA LOW NOX BURNER

(71) Applicant: Jianhui Hong, Buffalo Grove, IL (US)

(72) Inventor: Jianhui Hong, Buffalo Grove, IL (US)

(73) Assignee: Preferred Utilities Manufacturing Corporation, Danbury, CT (US)

( * ) Notice: Subject to any disclaimer, the term of this patent is extended or adjusted under 35 U.S.C. 154(b) by 358 days.

(21) Appl. No.: 15/347,900

(22) Filed: Nov. 10, 2016

(65) Prior Publication Data

US 2018/0128479 A1 May 10, 2018

(51) Int. Cl.
*F22B 9/00* (2006.01)
*F22B 37/00* (2006.01)
*F22B 7/12* (2006.01)

(52) U.S. Cl.
CPC ..... *F22B 37/008* (2013.01); *F22B 7/12* (2013.01)

(58) Field of Classification Search
CPC ..... F22B 37/008; F22B 7/12; F24H 1/206; F24H 9/18; F24H 9/1809; F24H 9/1836; F24H 2210/00
See application file for complete search history.

(56) References Cited

U.S. PATENT DOCUMENTS 7,051,683 B1 * 5/2006 Lee ..... F23N 5/123 122/14.21
8,083,518 B2 * 12/2011 Tanaka ..... B01D 53/8646 423/239.1
2012/0177553 A1 * 7/2012 Lindemann ..... F23J 7/00 423/239.1

FOREIGN PATENT DOCUMENTS

WO WO 82/01931 * 6/1982

* cited by examiner

*Primary Examiner* — Alfred Basichas
(74) *Attorney, Agent, or Firm* — Jianhui Hong

(57) ABSTRACT

The current invention disclose a method and apparatus for production of hot water or steam in a firetube boiler, said method comprising the steps of producing a first flue gas using a first stage of a burner in a first pass of a firetube boiler; passing at least a portion of said first flue gas through a second pass of said boiler, wherein said second pass comprises a plurality of firetubes; routing said portion of said first flue gas to a second stage of said burner to reduce NOx emissions from said second stage of said burner; producing a second flue gas from said second stage of said burner in a third pass of said boiler; passing said second flue gas through a fourth pass of said boiler, wherein said fourth pass comprises a plurality of firetubes.

10 Claims, 5 Drawing Sheets

SECTION A-A

METHOD AND APPARATUS FOR FIRETUBE BOILER AND ULTRA LOW NOX BURNER

This is a continuation of application Ser. No. 14/941,842 filed on Nov. 16, 2015.

BACKGROUND OF THE INVENTION

1. Field of the Invention

This invention relates generally to a firetube boiler and a burner system for the production of hot water or steam. More particularly, this invention relates to the production of hot water or steam using a firetube boiler and a burner system that are designed to produce ultra low NOx emissions and higher efficiency at the same time. The firetube boiler and the burner of this invention are specifically designed to work with each other.

2. Description of the Related Art

Boilers are widely used for the generation of hot water and steam. A conventional boiler (excluding Heat Recovery Steam Generator or HRSG) comprises a furnace in which fuel is burned, and surfaces typically in the form of steel tubes to transfer heat from the flue gas to the water. A conventional boiler has a furnace that burns a fossil fuel or, in some installations, waste fuels or biomass derived fuels. According to the website of Britannica, the first boiler with a safety valve was designed by Denis Papin of France in 1679; boilers were made and used in England by the turn of the 18th century. Most conventional boilers are classified as either firetube boilers or watertube boilers. In a firetube boiler, the water surrounds the steel tubes through which hot flue gases from the furnace flow. In a watertube boiler, the water is inside the tubes with the hot flue gases flowing outside the tubes. One example of firetube boilers is Scotch Marine firetube boilers. There have been relatively few innovations in the designs of firetube boilers in the last few decades. Several incremental improvements aimed to enhance the heat transfer efficiency of the firetube boilers. The introduction of helical ribs inside the firetubes (also known as "spiral tubes" or "gun barrel tubes") and spiral turbulators inserted inside the tubes, are a couple of examples of such incremental improvements. The recent innovations have been focused on low NOx and ultra low NOx burner technologies. However, innovations in the low emission burners have been hampered by the lack of innovations in the firetube boilers. In order for low emission burner technologies to make further progress, there exists a need for a holistic approach, to treat the firetube boiler and the burner as an integral system, rather than two separate and loosely related sub-systems.

NOx is a recognized air pollutant. Regulations on NOx tend to get more stringent in densely populated areas of the world. In some areas, local regulations require low NOx or even ultra low NOx emissions in the exhaust from the combustion processes of the boilers. Various low NOx and ultra low NOx burners are available in the market to meet these requirements. A review of typical NOx reduction methods can be found in the article "NOx emissions: Reduction Strategy" in "Today's Boiler" magazine Spring 2015 by Jianhui Hong. FGR (Flue gas recirculation) is a commonly used technique for NOx reduction. In one approach called "forced FGR", FGR is added into the burner system downstream of the combustion air blower with the help of a separate FGR blower. Flue gas is pulled from the stack and pushed through some sort of manifold or bustle ring into the flame. The forced FGR approach is more energy efficient in terms of electrical consumption for the combustion air blower. However it often requires a factory modified burner capable of forced FGR. From a control standpoint, the forced FGR cannot be substantially self-controlled like induced FGR. The addition of a separate FGR blower demands accurate and reliable control of the rate of FGR relative to the rate of combustion air, making the control more complicated.

In another approach called "Induced FGR", flue gas is drawn through a duct to the inlet of the air blower and mixed with the combustion air by using the blower wheel as a mixing device. The flue gas is typically at a higher temperature than the ambient air. The introduction of flue gas into the blower can sometimes lead to condensation, corrosion, and heat damage to some burner equipment. For example, condensation on the spark ignition system could render it inoperable due to electric short-circuit. Corrosion to the internal parts of the blower and the burner head can occur due to condensation. Heat and condensation from the flue gas can damage or interfere with the flame scanner, which is a part of the burner management system. The heat can also transmit through the shaft of the electric motor and damage the motor if the shaft is not properly cooled.

According to the Perry's Chemical Engineers' Handbook ($7^{th}$ Edition) Section 10-46, the horsepower requirement for a blower is determined by the multiplication of two factors, the volumetric flow rate through the blower in cubic feet per minute, and the blower operating pressure in inches water column. Induced FGR increases both the volumetric flow rate through the blower and the pressure drop through the burner and the boiler (hence increasing the blower operating pressure required), and therefore greatly increases the horsepower requirement for the blower motor. In this sense, induced FGR penalizes the blower horsepower requirement twice, once for the extra volumetric flow rate, and another for the extra pressure drop through the boiler and burner system.

U.S. Pat. No. 5,407,347A teaches an apparatus and method for reducing NOx, CO and hydrocarbon emissions when burning gaseous fuels. The advantage of this invention is that ultra low NOx emission can be achieved at relatively low oxygen level (such as 3% dry volume basis) in the flue gas. The shortcoming of this technology is that a large amount of FGR (up to 40% of combustion air by mass) is required to achieve <9 ppm NOx emissions. In addition, the rapid mixing design requires large pressure drops across the swirl vanes in the combustion air pathway near the burner head. Since mixing rate slows down with flow velocity, this design also has a limited turndown for ultra low NOx performance. Due to the large amount of FGR and the high pressure drop the air/FGR mixture has to overcome, a larger motor and a larger combustion air blower are required compared to some other alternative ultra low NOx burner technologies. The larger motor means higher initial capital costs, higher electricity consumption and higher noise during the burner's operation. In the state of California in particular, operators of boilers often dislike use of FGR, perhaps due to the concerns of earthquake and the additional mandatory structural inspection related to the field installation of the FGR pipe. U.S. Pat. No. 6,776,609 also discussed the motor size penalty problem in details related to the use of Induced FGR.

Another commonly used technique for ultra low NOx is called "lean premixed combustion". U.S. Pat. No. 6,776,609 was intended to teach a method for operating a burner with FGR, but it also discussed the disadvantages of the lean premixed combustion method based on fiber matrix. It disclosed that "Alzeta Corp. of Santa Clara, Calif. sells a burner for use in food processing and other industries that utilizes only excess combustion air (no FGR) to achieve the flame dilution necessary for 9-ppm NOx emissions. A dilution level of 60% on a mass basis is required". Using the same dilution principle, Power Flame Corporation offers a product called Nova Plus. It uses metal fiber matrix elements for the "fully premixed surface stabilized combustion".

Another technique for ultra low NOx relies on lean premixed combustion, but it does not use fiber matrix elements. Sellers Manufacturing, a subsidiary of Green Boiler Technologies, sells an S-Series boiler that generates 9 ppm NOx level using lean premixed combustion based on injection nozzles instead of fiber matrix elements. A fully premixed air/fuel mixture goes through multiple injection nozzles at relatively high velocity to resist flashback to areas upstream of these injection nozzles. These premix burners have limited turndown due to flashback concerns.

The shortcomings of the "lean premixed combustion" technique are well recognized in the combustion community: low thermal efficiency due to the very high excess air level and the resultant very high oxygen level in the flue gas (9% oxygen is typical), and the extra electricity consumption due to the extra excess air for the dilution and flame cooling. The large amount of excess air was intended to reduce the peak flame temperature by dilution effects. The extra dilution air carries additional heat into the atmosphere (wasted heat) when the exhaust is vented out of the stack, and causes a reduction of thermal efficiency.

In view of the foregoing, there exists a need for an improved method and apparatus for production of hot water and steam that can produce low NOx (including ultra low NOx) emissions, low electricity consumption for the motor and high thermal efficiency at the same time.

SUMMARY OF THE INVENTION

It is a general object of the present invention to provide a method and apparatus for the production of hot water or steam in a firetube boiler and a burner system that produces low NOx emissions, low electricity consumption and high thermal efficiency.

A more specific object of the present invention is to provide a method and apparatus for the production of hot water or steam in a firetube boiler and burner system that produces ultra low NOx emissions in the flue gas, low oxygen level in the flue gas which leads to higher thermal efficiency, low horsepower requirement for the blower motor for the burner.

These objects are achieved by a method of producing hot water or steam, comprising the steps of, producing a first flue gas using a first stage of a burner in a first pass of a firetube boiler;

passing at least a portion of said first flue gas through a second pass of said boiler, wherein said second pass comprises a plurality of firetubes; routing said portion of said first flue gas to a second stage of said burner to reduce NOx emissions from said second stage of said burner; producing a second flue gas from said second stage of said burner in a third pass of said boiler; passing said second flue gas through a fourth pass of said boiler, wherein said fourth pass comprises a plurality of firetubes.

These objects are achieved by an apparatus for producing hot water or steam, comprising a firetube boiler and a burner; said firetube boiler comprising a shell substantially cylindrical in shape, having a front end and a back end; a front tube sheet and at least one back tube sheet; two furnace tubes and a plurality of firetubes positioned inside the shell and substantially extending the length of the shell from the front end to the back end, said furnace tubes form a first pass and a third pass, said firetubes form a second pass and a fourth pass in the boiler, wherein said first pass comprises a furnace tube and allows a first flue gas to be produced and flow in the direction from the front end to the back end; said second pass comprises a plurality of firetubes and allows said first flue gas to flow in the direction from the back end to the front end; said third pass comprises a furnace tube and allows a second flue gas to be produced and flow in the direction from the front end to the back end; and said fourth pass comprises a plurality of firetubes and allows said second flue gas to flow in the direction from the back end to the front end; and said burner comprising a burner affixed to the front end of said firetube boiler comprising a first stage that produces said first flue gas; a second stage that produces said second flue gas; wherein at least a portion of said first flue gas goes through said second pass of said boiler, and is routed to the second stage of the burner to reduce NOx emissions from said second flue gas; said second flue gas goes through said fourth pass of said boiler.

Additional objects and features of the invention will appear from the following description from which the preferred embodiments are set forth in detail in conjunction with the accompanying drawings.

BRIEF DESCRIPTION OF THE DRAWINGS

Identical reference numerals throughout the figures identify common elements.

DESCRIPTION OF THE PREFERRED EMBODIMENTS

For the purpose of this invention, a burner shall mean a device to produce one or more flames in the firetube boiler of the current invention in a controlled manner, taking inputs from at least one fuel source and an oxidizer source such as air. The two stages of the burner disclosed in this invention could arguably be referred to as two separate burners by anyone skilled in the art. Such change of nomenclature does not create a new invention outside the scope of the current invention.

Figure 1:
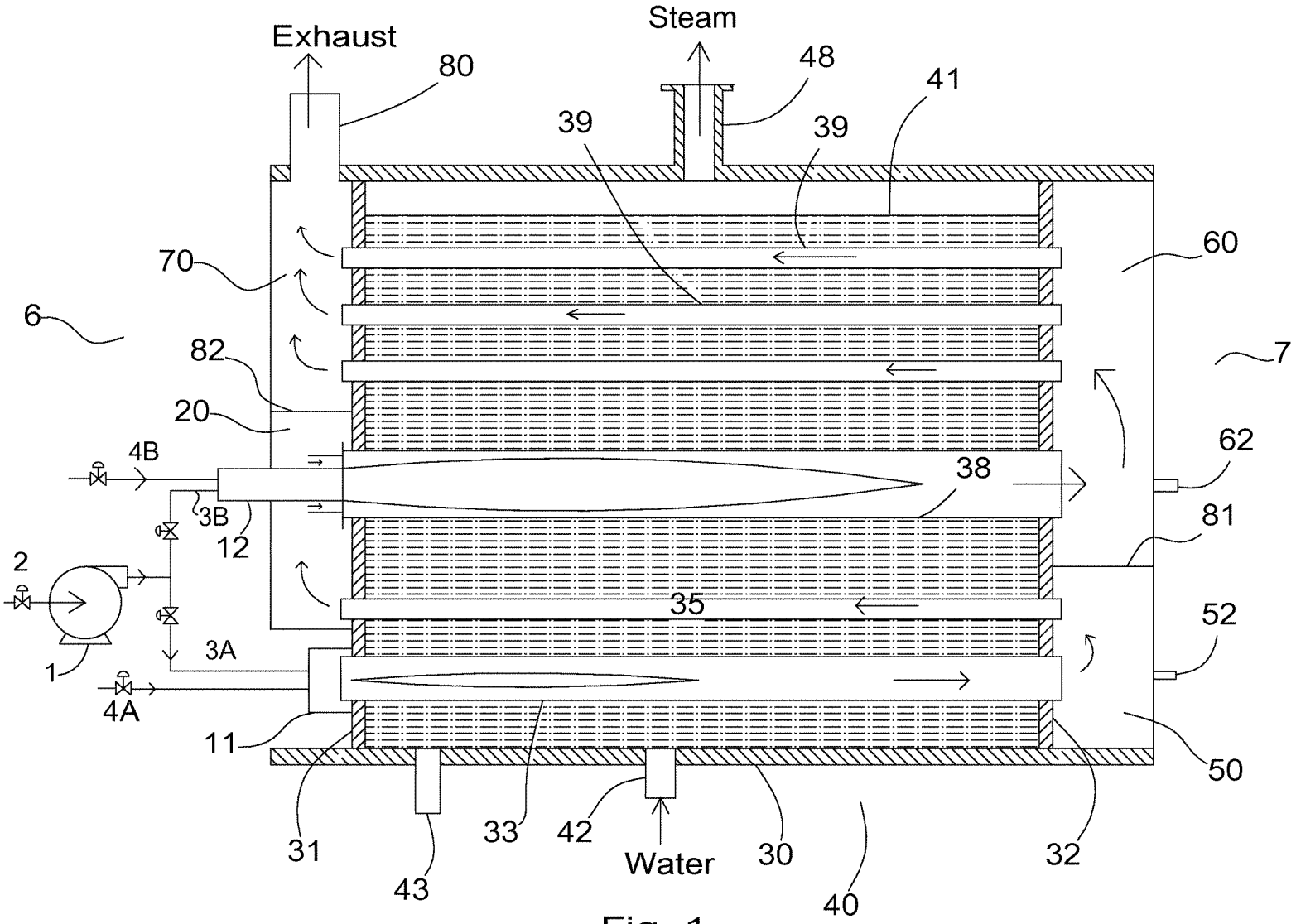
FIG. 1 is a schematic view of an apparatus for producing steam in accordance with the present invention.

FIG. 1 shows a schematic view of an apparatus for the current invention. A boiler 5 has a cylindrical shell 30, which is welded to a front tube sheet 31 and a rear tube sheet 32 to form a pressure vessel 40. Furnace tubes 33 and 38 are positioned in the shell 30 to extend the length of the shell from tube sheet 31 and to tube sheet 32, and sealingly attached (typically welded) to these tube sheets per firetube boiler codes. A plurality of firetubes 35 and 39 are also positioned in the shell 30 to extend the length of the shell from tube sheet 31 to tube sheet 32. These firetubes are sealingly attached to these tube sheets, commonly by tube expansion (also called "tube rolling"). The boiler 5 in FIG. 1 could be a horizontal boiler or a vertical boiler.

The boiler 5 has a front end 6 near tube sheet 31, and a back end 7 near tube sheet 32. Feed water is supplied into the boiler through water inlet 42. When necessary, water can be drained through drain outlet 43. Steam is collected in the vapor space within the pressure vessel 40 and above the water level 41, and discharged through steam outlet 48 when pressure is higher than a desired pressure setpoint.

A burner 10 has a first stage 11 and a second stage 12. Each of these two stages of the burner 10 comprises means for supplying a fuel and combustion air in a proper air/fuel ratio so that combustion can be sustained, a means of ignition, and a means for flame monitoring to ensure safety. The first stage of the burner 10 comprises a first fuel supply 3A and a first combustion air supply 4A in a proper air/fuel ratio so that a first flame can be sustained inside furnace tube 33, a first means of ignition, and a first means of flame monitoring. The second stage of the burner 10 comprises a second fuel supply 3B and a second combustion air supply 4B in a proper air/fuel ratio so that a second flame can be sustained inside furnace tube 38, a second means of ignition, and a second means of flame monitoring. For clarity and simplicity of illustration, some details of these two stages of the burner are omitted in FIG. 1. The combustion air to these two stages of the burner may be supplied by two separate blowers, or may preferably be supplied by a single blower to take full advantage of this invention. The fuel supplied to these two stages of the burner may be taken from the same source, or two separate sources of fuel. Fuel supplies to these two stages (11 and 12) may be modulated or shutoff. Means for flame monitoring may include but are not are limited to UV, IR, flame rod and any other method.

The first stage 11 of the burner 10 produces a flame in a furnace tube 33. The flue gas from the first stage is referred to as the first flue gas. The furnace tube 33 is also called the first pass. The first flue gas flows in the first pass in the direction from the front end 6 to the back end 7, then exits from the first pass into a chamber 50 affixed to the back end 7. The first flue gas then goes through a plurality of firetubes 35 (only one firetube 35 shown in FIG. 1, but this schematic illustration is for illustrating the concept, not to be taken literally), which are referred to as the second pass of the boiler, in the direction from the back end 7 to the front end 6, and discharges into a chamber 20 affixed to the front end 6. The second stage 12 of the burner is disposed in chamber 20 to produce a flame in a furnace tube 38. The first flue gas in chamber 20 is injected into the flame of the second stage 12 to reduce the peak flame temperature, and thus reduce NOx emissions from the second stage 12 of the burner 10. Using flue gas to reduce NOx emissions is well understood in the combustion community.

The advantages of the current invention include three aspects: 1) the first flue gas does not go through the wheel of any blower, thus reducing the motor horsepower requirement and electricity consumption of the motor; 2) the use of the first flue gas helps reduce the oxygen level in the second flue gas while achieving the desired NOx levels, thus improves the thermal efficiency of the boiler; 3) there is no need for an external FGR pipe or a separate FGR blower. Elimination of the external FGR pipe or the separate FGR blower is advantageous as is discussed in the section of "Description of Related Art".

The second stage 12 produces a second flue gas in the furnace tube 38, which is referred to as the third pass of the boiler. The second flue gas exits the third pass and discharges into a rear chamber 60, and goes through a plurality of firetubes 39, which are the fourth pass of the boiler. The second flue gas exits the fourth pass, and discharges into a flue gas collection chamber 70, and is vented out of the boiler through flue gas outlet 80. The rear chambers 60 and 50 are separated by a divider 81, which is made out of a refractory material since the flue gases on both sides are at elevated temperatures. The chambers 20 and 70 are separated by a divider 82, which could be made out of steel, since the flue gases on both sides are at relatively low temperatures (for example, 250-400 degree Fahrenheit).

The stages 11 and 12 of the burner 10 are both located in the vicinity of the front end 6. The observation ports 52 and 62 are located in the vicinity of the back end 7. Ports 52 and 62 allow manual observation of the flames in furnace tube 33 and furnace tube 38, respectively. For simplicity, insulation and refractory materials commonly used for boilers are not shown in any figures in this invention.

It is well known that burners can be classified as premix type or diffusion type (also known as non-premix type), depending on whether the fuel and air is mixed well before combustion is initiated. Each of the stages 11 and 12 in FIG. 1 can be either a premix type or diffusion type. The first flue gas from the first stage 11 is an intermediate fluid that is not vented out of the boiler directly. In a sense, high NOx or CO in the first flue gas has no consequence if these pollutants are subsequently destroyed in the second stage 12. From a practical standpoint, NOx, once formed in the first flue gas, will be difficult to destroy in the second stage 12. Therefore it is desirable to keep the NOx level as low as possible in the first flue gas. In contrast, CO and oxygen levels can be high in the first flue gas, without causing any adverse effects on the overall performance of the boiler and the burner system, since CO and oxygen can be consumed by the flame of the second stage 12. This fact adds to the design and operational flexibility of the burner.

In a particular embodiment, a single blower 1 supplies combustion air to both stages 11 and 12 of burner 10. Combustion air is drawn in from inlet 2 by the blower 1, goes through air duct 3A and 3B to the first stage 11 and the second stage 12, respectively. A fuel, such as natural gas, propane or fuel oil, is supplied from a single source (not shown) through fuel lines 4A and 4B to stage 11 and 12 of burner 10, respectively. The fuel flows through 4A and 4B are modulated by modulation valves and can be shut off by safety shutoff valves (not shown). Combustion air flow through 3A and 3B are modulated by two dampers and a variable frequency drive (not shown) on the motor of the blower. One air damper is installed in the air inlet duct 2, controlling the total amount of combustion air supplied to both stages 11 and 12. The other air damper is installed in the air duct 3B to control the percentage of air supplied to stage 12. The air supplied through air duct 3A to the first stage 11 has to go through more passes than the air supplied through air duct 3B. Therefore there is a natural tendency for combustion air to prefer the path of 3B. For this reason, an air damper in the air duct 3B is preferred. Stage 11 and stage 12 are both equipped with independent and separate means for ignition and flame monitoring systems (not shown).

The first stage 11 is generally rated for a smaller fraction of the total heat input of the burner 10 than the second stage 12. The heat input of the first stage 11 as a percentage of the total heat input of burner 10 depends on the need of flue gas for the second stage. The more flue gas is needed for NOx suppression in the second stage, the larger fraction the first stage needs to be. There is an upper limit on how much flue gas the second stage can take before the second stage becomes unstable. In general, the first fuel supply of the first stage 11 should account for 10-33% of the total heat input of the burner 10, and the second fuel supply of the second stage accounts for the balance of the heat release.

In one particular embodiment, the first stage of the burner 11 utilizes the "lean premix" technique commonly used in conventional ultra low NOx burners. The high excess air was used to lower the peak flame temperature, which in turn suppresses formation of thermal NOx. The higher oxygen level in the first flue gas allows the NOx emissions in the first flue gas to reach ultra low NOx levels. In one embodiment, the first stage could be operated with 5-11% oxygen (dry volume based) in the first flue gas, depending on the requirement of NOx emissions. For example, at 9-11% oxygen (dry volume based) in the first flue gas, 4-6 ppm NOx (dry volume based, corrected to 3% oxygen) can be achieved with less than 50 ppm CO. Lean premix associated with "surface combustion" type burners are well known for lower efficiency, due to the increased heat loss to the stack exhaust. This shortcoming is overcome in the current invention. The higher level of oxygen in the first flue gas does not result in lower efficiency of the boiler, because at least some of the oxygen in the first flue gas will be consumed in the second stage of the burner. The oxygen level in the second flue gas is maintained at lower levels such as 1-5% (dry volume based), preferably at 1-3% (dry volume based) to achieve high thermal efficiency of the boiler.

Burner 10 can be operated in two modes. In a first mode, the first stage 11 and second stage 12 are both in operation, converting fuel and air into flue gas and generating heat. This is the normal mode of operation where low and ultra low NOx emissions are desired. In a second mode, the first stage 11 is in operation, and the second stage 12 is turned off. In this mode of operation, the flue gas from the first stage 11 still goes through the first, second, third and fourth passes of the boiler, but the fuel supply to the second stage is turned off. The combustion air supply to the second stage of the burner is kept on but modulated to a minimal flow rate, just to prevent the flue gas from the second pass of the boiler to back flow into the second stage and cause damages to the burner head. This is the mode of operation when extremely high turndown (24:1 to 30:1) is desired for the boiler. Caution should be used to limit the maximum turndown to avoid condensation in the firetubes, if the boiler is not designed as a condensing boiler.

Figure 3:
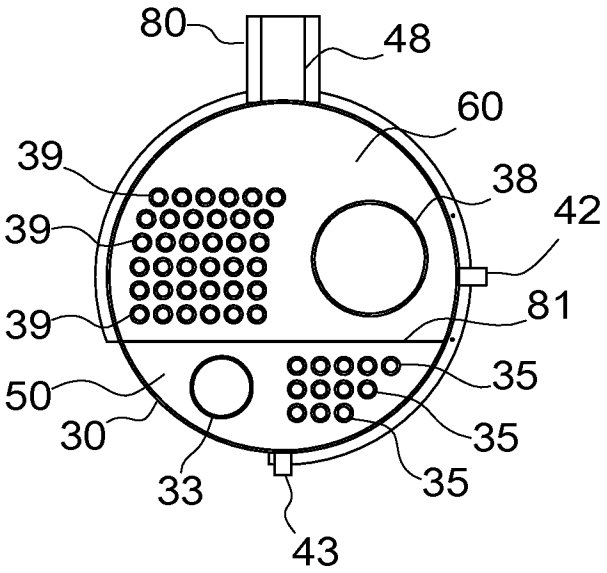
FIG. 3 is a rear view of the same boiler in FIG. 2, with rear cover removed.
Figure 2:
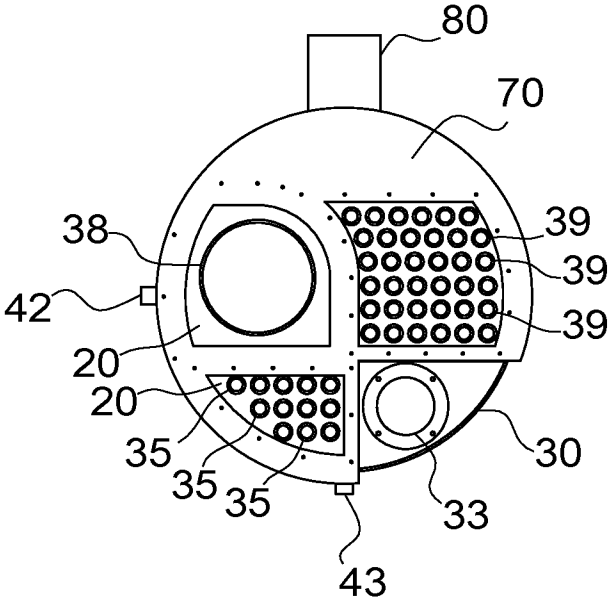
FIG. 2 is a front view of an embodiment of the firetube boiler with front covers removed.

FIGS. 2 and 3 show the front and rear views of an embodiment of the firetube boiler according to the current invention. The four passes are generally divided into four quadrants. FIG. 3 shows how the divider 81 separated a rear smokebox into two chambers 50 and 60. A refractory insulated backcover (not shown), as is commonly seen in firetube boilers, when installed, should seal tightly against this divider 81, to prevent the first flue gas from the chamber 50 to go directly to chamber 60, bypassing the second pass.

Figure 4:
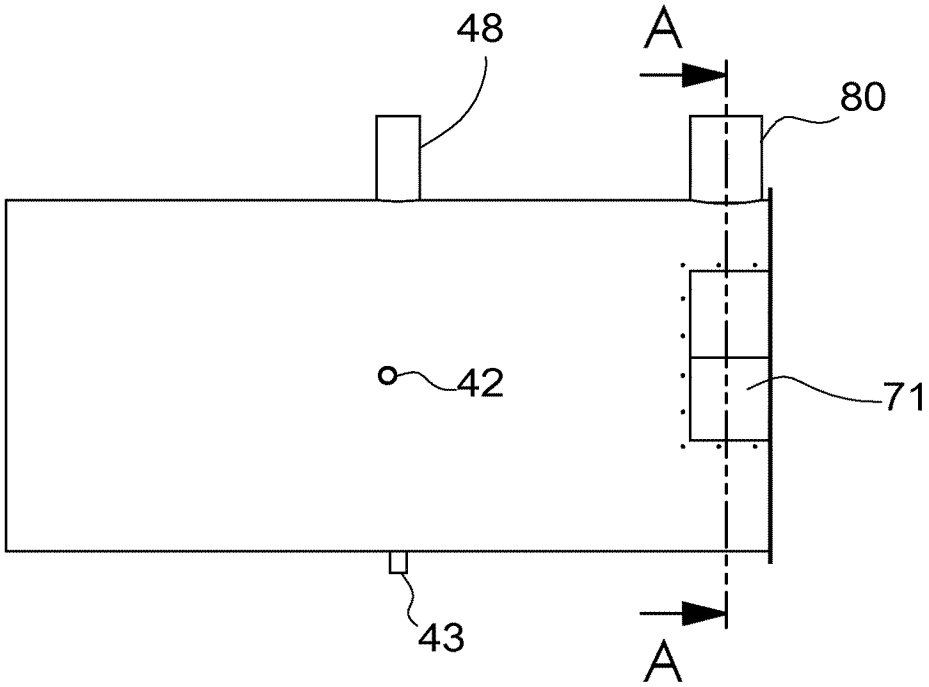
FIG. 4 is a side view of the same boiler in FIG. 2 without the front and rear covers.

FIG. 4 shows a side view of the boiler in FIG. 2. Note the side opening 71 is for easy access to the second stage 12. The cover for the side opening 71 is not shown.

Figure 5:
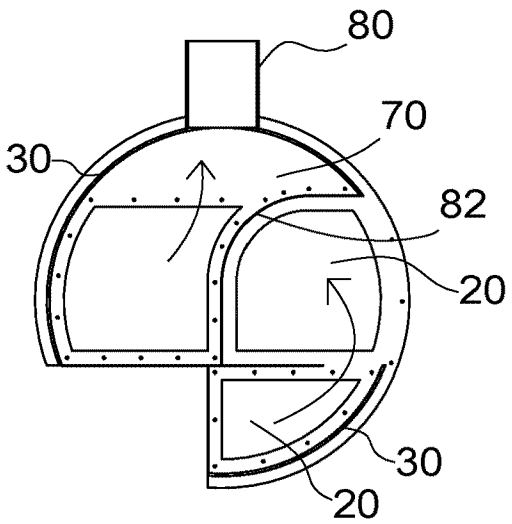
FIG. 5 is section view along section line A-A.

FIG. 5 shows a section view along section line A-A in FIG. 4. It shows the first flue gas moving from the lower section of the front chamber 20 to the upper section of front chamber 20. The upper and lower sections of chamber 20 are fluidically communicating with each other. They can be partially divided, to guide the flow pattern of the first flue gas. It also shows the second flue gas flows in chamber 70 to the exhaust stack 80. The divider 82 separates chamber 20 from chamber 70.

Figure 6:
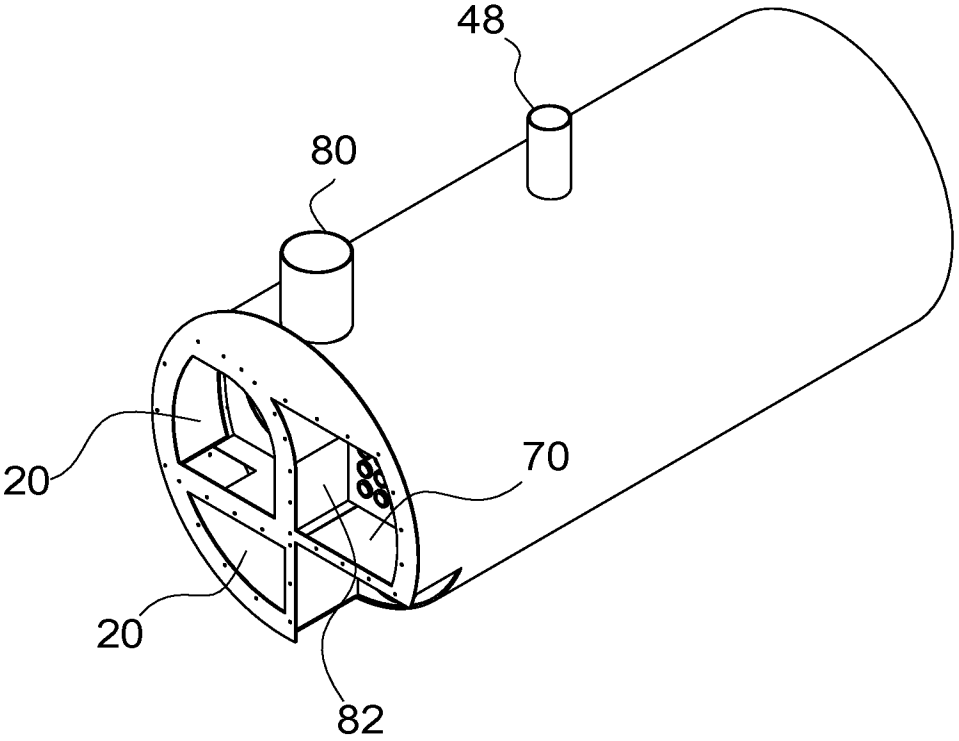
FIG. 6 is a perspective view of the same boiler in FIG. 2.
Figure 7:
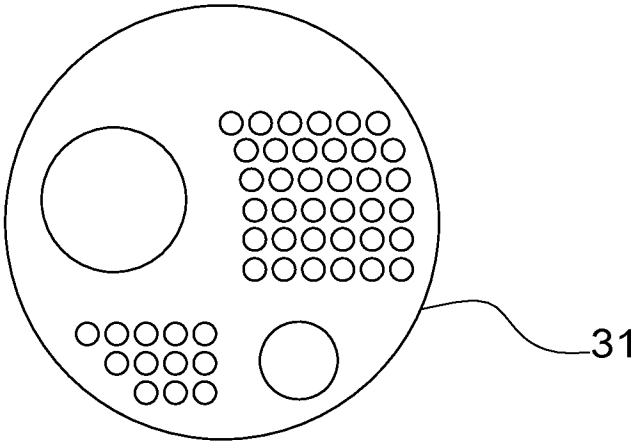
FIG. 7 is a front view of the tube sheet 31 or 32.

FIG. 6 shows a perspective view of the boiler in FIG. 2. FIG. 7 shows a front view of the tube sheets 31 or 32. Tube sheets 31 and 32 are identical.

Some common elements such as handholes and ports for water level control were omitted in these figures for clarity of illustration.

The third and fourth passes (furnace tube 38 and firetubes 39) of the boiler in FIG. 1, correspond to the first and second passes of a two-pass boiler, if the first stage 11, furnace tube 33 and firetubes 35 are thought of as a dedicated flue gas generator. The third and fourth passes can arguably be referred by anyone skilled in the art as the first and second passes associated with the second stage 12 of the burner, since fuel and air from the second stage 12 is indeed making a first and second passes through the boiler. However, during normal operation, the first flue gas from the first stage 11 of the burner have already made two passes (furnace tube 33 and firetubes 35) through the boiler when they go through furnace tube 38 and firetubes 39, and therefore making a third and fourth passes through the boiler.

Calling furnace tube 38 and firetubes 39 as first and second passes for the second stage 12 of the burner by anyone skilled in the art is simply a choice of nomenclature, and does not create a new invention outside the scope of this invention.

It is common in the firetube boiler industries to have one-pass, two-pass, three-pass and four-pass conventional firetube boilers. Additional passes can be added to the boiler in FIG. 1. For example, a fifth pass could be added to the boiler in FIG. 1 allowing flue gas from the fourth pass to flow in the direction from front end to the back end, and the exhaust outlet 80 would move to the back end of the boiler, similar to a conventional 3-pass boiler. Similarly, a sixth pass could be added, and the exhaust outlet 80 would stay at the front end of the boiler, similar to a conventional 4-pass boiler.

It is common in the firetube boiler industries to have dry back and wet back designs. FIG. 1 shows a dry back design. But a wet back design could be easily implemented for the current invention by anyone skilled in the art, after reviewing the current disclosure.

As is well understood in the boiler industry, if hot water production is desired instead of steam, steam outlet 48 in FIG. 1 would be replaced by a hot water outlet located at a proper location on the shell 30.

The foregoing description, for purposes of explanation, used specific nomenclature to provide a thorough understanding of the invention. However, it will be apparent to one skilled in the art that the specific details are not required in order to practice the invention. In other instances, well known devices are shown in block diagram form in order to avoid unnecessary distraction from the underlying invention. Thus, the foregoing descriptions of specific embodiments of the present invention are presented for purposes of illustration and description. They are not intended to be exhaustive or to limit the invention to the precise forms disclosed. Obviously many modifications and variations are possible in view of the above teachings. The embodiments were chosen and described in order to best explain the principles of the invention and its practical applications, the thereby enable others skilled in the art to best utilize the invention and various embodiments with various modifications as are suited to the particular use contemplated. It is intended that the scope of the invention be defined by the following claims and their equivalents.

What is claimed is:

1. A method of producing hot water or steam, comprising the steps of, a) producing a first flue gas using a first stage of a burner in a first pass of a firetube boiler, wherein said first stage comprises a first fuel supply and a first combustion air supply in a proper air/fuel ratio so that a first flame can be sustained, a first means of ignition, and a first means for flame monitoring;

b) passing at least a portion of said first flue gas through a second pass of said boiler, wherein said second pass comprises a plurality of firetubes;

c) routing said portion of said first flue gas to a second stage of said burner to reduce NOx emissions from said second stage of said burner;

d) producing a second flue gas from said second stage of said burner in a third pass of said boiler, wherein said second stage comprises a second fuel supply and a second combustion air supply in a proper air/fuel ratio so that a second flame can be sustained, a second means of ignition, and a second means for flame monitoring;

e) passing said second flue gas through a fourth pass of said boiler, wherein said fourth pass comprises a plurality of firetubes.

2. The method as described in claim 1 further comprises a step of passing said second flue gas through a fifth pass of said boiler, wherein said fifth pass comprises a plurality of firetubes.

3. The method as described in claim 2 further comprises a step of passing said second flue gas through a sixth pass of said boiler, wherein said sixth pass comprises a plurality of firetubes.

4. The method as described in claim 1 wherein the first stage and the second stage of the burner are supplied with combustion air from a single blower.

5. The method as described in claim 1 wherein the first fuel supply accounts for 25% of the total heat input of said boiler, and the second fuel supply accounts for the rest of the total heat input.

6. The method as described in claim 1 wherein the first fuel supply accounts for 10-33% of the total heat input of said boiler, and the second fuel supply accounts for the rest of the total heat input.

7. The method as described in claim 6 wherein the first stage comprises a burner head of a premix combustion type.

8. The method as described in claim 7 wherein the first stage is operated with 5-11% oxygen in the first flue gas.

9. The method as described in claim 7 wherein the second stage is operated with 1-5% oxygen in the second flue gas.

10. The method as described in claim 7 wherein the second stage is operated with 1-3% oxygen in the second flue gas.

* * * * *